US006041629A

United States Patent [19]

Hughes

[11] Patent Number: 6,041,629

[45] **Date of Patent: *Mar. 28, 2000**

[54] LOCK PICKING APPARATUS

[76] Inventor: Donald R. Hughes, 6120 W. Tropicana, Suite A16-176, Las Vegas, Nev. 89103-4694

[ * ] Notice: This patent is subject to a terminal disclaimer.

[21] Appl. No.: 09/354,669

[22] Filed: Jul. 16, 1999

Related U.S. Application Data

[60] Division of application No. 08/933,128, Sep. 18, 1997, Pat. No. 5,956,984, which is a continuation-in-part of application No. 08/583,476, Jan. 5, 1996, abandoned.

[51] Int. Cl.[7] ..... E05B 19/20

[52] U.S. Cl. ..... 70/394; 70/397; 70/398; 70/409; 70/494

[58] Field of Search ..... 70/394, 395, 494, 70/495, 397, 398, 400, 405–407, 401, 409, 410; 33/539, 540

[56] References Cited

U.S. PATENT DOCUMENTS

| | | | |
|---|---|---|---|
| 2,087,423 | 7/1937 | Abrams . | |
| 3,827,151 | 8/1974 | Naill | 70/394 X |
| 3,985,010 | 10/1976 | Idoni | 70/394 X |
| 3,987,654 | 10/1976 | Iaccino et al. | 70/378 X |
| 4,073,166 | 2/1978 | Clark | 70/413 X |
| 4,185,482 | 1/1980 | Nail | 70/394 |
| 4,606,204 | 8/1986 | Cooke, Jr. | 70/394 |
| 4,667,494 | 5/1987 | Joosten | 70/394 |
| 5,083,662 | 1/1992 | Bishop et al. | 70/456 R X |
| 5,172,578 | 12/1992 | Bitzios | 70/398 X |
| 5,224,365 | 7/1993 | Dobbs | 70/408 X |
| 5,289,709 | 3/1994 | Field | 70/403 X |
| 5,355,702 | 10/1994 | Escribens | 70/398 X |

FOREIGN PATENT DOCUMENTS

| | | | |
|---|---|---|---|
| 2392202 | 1/1978 | France | 70/394 |
| 49199 | 4/1977 | Japan | 70/394 |
| 51-297 | 4/1977 | Japan | 70/394 |
| 51-298 | 4/1977 | Japan | 70/394 |
| WO87/04748 | 8/1987 | WIPO | 70/495 |

*Primary Examiner*—Lloyd A. Gall
*Attorney, Agent, or Firm*—Jack C. Munro

[57] ABSTRACT

The method and apparatus for picking a lock which utilizes a single blade or pair of elongated thin, rigid, interchangeable blades which are to be inserted within the keyway of the lock. Each of the blades have an upper hiatused surface and can have an off-center sharpened edge so that the sharpened edge will contact the cylindrical lock pins of the lock spaced from the center of each of the lock pins. The off-center sharpened edge could be formed by beveling the side of the blade or by making a cutout in the blade. The hiatused surface of the blades cause the lock pins of the lock to move lineally with the sharpened edge causing the lock pins to pivot. Instead of a hiatused surface, there could be used one or more deflectable members, tufts of bristles or a brush. The blades are to be driven in a reciprocal manner with one blade moving in and the opposite blade moving out. The driving of the blades in an in and out linear motion can be accomplished either by an electrical motor or by a mechanical manually operated mechanism.

11 Claims, 6 Drawing Sheets

LOCK PICKING APPARATUS

This application is a divisional patent application of Ser. No. 08/933,128, filed Sep. 18, 1997, U.S. Pat. No. 5,956,984 entitled LOCK PICKING APPARATUS, by the present inventor, which was a continuation-in-part of patent application Ser. No. 08,583,476 filed Jan. 5, 1996, entitled LOCK PICKING APPARATUS, by the present inventor, now abandoned.

BACKGROUND OF THE INVENTION

1) FIELD OF THE INVENTION

The field of this invention relates to all types of pin tumbler and wafer tumbler locks, including but not limited to vertically spring biased pins and wafers, horizontally spring biased pins and wafers, including single sided and double sided spring biased pins within a lock housing. This also includes locks with and without a shear line, as well as locks that use a locking sidebar. This invention is specifically directed to a specific type of cylindrical lock which utilizes pins within a chamber with those pins to be moved lineally. But also the pins could be pivoted to a rotated position in order for a sidebar to enter so as to permit opening of a lock. This invention also pertains to a lock of similar construction where the pins within the separate chambers are to not only be moved lineally to a shear line, but also must be pivoted in order to permit a sidebar to engage before successfully operating the lock. The latter lock is much more complicated than prior locks and is known as a far more secure type of lock as it has literally thousands of additional combinations available.

2) DESCRIPTION OF THE PRIOR ART

Lock picks have long been known. The present inventor, in years past, has designed and patented a lock pick for a tubular type of lock. For the cylindrical type of lock, which utilizes a plurality of lineally movable lock pins within a plug, the normal lock picking type of device has been to insert a thin elongated member, commonly known as a blade, having an upper hiatused surface into the keyway of the lock and then to move that blade in an in-and-out manner relative to the lock while at the same time applying a torque to the plug. The purpose of moving the blade in and out is to cause the abutting surfaces of the upper and lower lock pins to move and be located at a shear line and when all the lock pins are located at the shear line, the lock will open, e.g. when the top pins are wholly contained in the lock housing and the bottom pins are wholly contained within the plug and the abutting surfaces of both top and bottom pins are located at a shear line, the lock will open. This lock picking procedure has always been done manually in the past. The in and out movement of the blade has always been done by hand, never mechanically or motor driven.

In an effort to construct a lock that would not be easily picked, there is manufactured a cylinder type of lock which not only requires that the lock pins be lineally displaced to be located at the shear line but also requires that each of the lock pins be pivoted to a particular position to engage with a locking sidebar. Just locating of the lock pins at the shear line is not sufficient. Each of the lock pins also has to engage in a correct mariner with a locking sidebar in order to permit the lock to open.

Prior to the present invention there has not been known any type of lock pick that could be utilized to open a lock that requires pivoting of the lock pins within the lock to a particular established position. Picking of locks is the common procedure utilized by locksmiths since people notoriously misplace or lose keys and now it is required that a lock has to be picked in order to gain access to a certain structure such as a car, house, padlock, vending machine, alarm system, laundry equipment, money changer, safe and so forth. If the lock is of the type previously described which utilizes pivoting pins, the only way that access could be gained would be by complete destruction of the lock requiring its replacement. It would certainly be advantageous to eliminate the replacement of the lock if the lock could be just picked.

SUMMARY OF THE INVENTION

The method and apparatus of the present invention utilizes interchangeable single and/or a pair of elongated, thin, rigid blades, each of which has a hiatused upper surface and a lower surface. These blades may be designed in a multitude of different edge configurations. The upper edge of a blade may be sharpened so that one side of the blade is beveled. When utilizing a double blade configuration, the blades are to be located in an abutting relationship with the bevels directly connected so as to form a space therebetween. Instead of a bevel, the blade could include a cutout area creating an L-shaped transverse cross-sectional configuration of the blade. If the beveling is slanted, the space will form a V-shape. If the cutout is used, the space between the blades will be in the shape of a rectangle. These edge configurations of blades can be combined in any manner. For example, suppose there are one hundred different edge configurations. Utilizing a pair of blades, there are one hundred sets with a right side blade and a left side blade constituting one set. Interchanging blades from the different sets establishes more than ten thousand possible blade combinations with each combination being unique as a set.

There also may be used a single blade with an upper edge that is sharpened into a knife edge. The sharpened edge is angled starting at a point below the deepest recess in the blade and is beveled to either the uppermost right or left side of the blade. The purpose for this single blade, sharpened in such a manner, is to cause the bottom pins of the lock to rotate which is caused by the single blade not making contact with the center of the bottom pins, but making off center contact with the bottom pins. This off-center contact of the bottom pins by the knife edge of the blade causes the pin in each chamber to not only raise and lower lineally, but also simultaneously to twist within the chamber that it is supported. In the type of a lock where there is utilized chisel tipped bottom pins and a sidebar with elongated protrusions to engage in a hole or groove located in the side of these chisel tipped bottom pins, this twisting is so as to align the sidebar with the grooves or holes in the pins. When the blade or blades are inserted within the keyway of a cylinder lock which has an aligned series of spring biased lock pins, those pins must be located at a shear line in order to permit opening of the lock. The off-center sharpened edge of the blade or blades will cause the chisel tipped pins to twist, as well as move lineally, because of the hiatused upper surface of the blade or blades. The blades are to be moved in a reciprocal manner within the keyway. When there are two blades being utilized, where the one blade is being driven outward, the opposite blade is being driven inward and vice versa. However, it is considered to be within the scope of this invention that the blades could be reciprocated in unison. The blades can be moved by a manually operated mechanism or can be moved by an electrically operated motor. Movement of these pins within the lock is to cause a shear line to be established resulting in the opening of a lock. It is to be understood that there may be utilized two sharpened blades together, or there could be utilized one regular type of blade that is not sharpened along with a sharpened blade, or there may be utilized a single blade that is sharpened. These sharpened configurations of the lock picking blades will result in twisting movement of the chisel tipped pins within the lock.

There are many different configurations of single blade type of lock picks that could possibly be utilized within the subject matter of this invention. The lock pick could include a single blade and instead of the upper surface of the blade being hiatused, it could include a plurality of spaced-apart upstanding deflectable members. These members will deflect as the blade goes in and out of the lock, and once a particular lock pin has reached the shear line and is locked in place at that shear line, those members will deflect and pass by that lock pin not unseating it, thereby not unseating it from the shear line. The lock pins become locked in place when such are no longer blocking the shear line. The deflectable members will then proceed only to move the lock pins that are not located at the shear line. Instead of utilizing a plurality of single deflectable members, there could be utilized a series of looped members. Also, the deflectable members could comprise a brush. One form of brush is a brush which has a circular arrangement of bristles. The bristles could also be arranged in a spiral pattern, said spiral pattern contacting each lock pin at an angle relative to the in and out direction of movement of the brush. The angular contact of the brush with the lock pin will tend to cause the lock pin to pivot. The lock picking blade could also include a series of tufts of bristles that are mounted in a longitudinally off-center position on the blade which would then function to also cause the lock pins to pivot as the blade is moved in and out of the lock. The blade could actually be constructed in the form of a key with the key being in a blank form or including a series of tufts of bristles. When in blank form, a separate blade is to be engaged with the key and moved relative to in and out of the lock with the key inserted in the keyway of the lock and applying a torque to the lock plug.

A concept of this invention is that the method used to obtain a more desired in and out motion of the picking of the lock is now reduced to a mechanical and/or motorized method that requires a minimum amount of effort in order to pick the lock. The in and out type of movement for picking of a lock in the past has been accomplished totally manually and required a substantial amount of time by the person attempting to pick the lock. Utilizing the lock picking apparatus of the present invention, this time and effort to manually pick a lock is substantially reduced with the lock picking apparatus for this invention actually doing the work of the lock picking procedure. The lock picking apparatus of this invention picks the locks for the user. Knowledge of the technical aspects of locks is not required.

One of the primary objectives of the present invention is to construct a lock pick that is capable of picking a lock which utilizes not only lineally movable lock pins that must be located at a shear line, but also requires that the lock pins be pivoted to a certain position in order for the lock to be opened.

Another objective of the present invention is to construct a lock picking apparatus that will utilize one or two rigid blades each of which have a hiatused upper surface with these blades to be inserted into the keyway of the lock with these blades to move in a reciprocal manner within the keyway, thereby utilizing a well known and highly practiced skill of picking locks. The movement of the blades can be accomplished manually or accomplished by a motor driven apparatus.

Another object of the present invention is to utilize a lock pick that has a plurality of interchangeable blades that actually make available over ten thousand combinations of different picking blades available.

Another objective of the present invention is to construct a lock picking apparatus that is capable of picking a lock which not only requires that a lineally movable set of lock pins must be located at a shear line, but also requires that the lock pins be pivoted to a certain position in order for a separate locking bar to engage with holes or grooves located along the sides of the pins in order for the lock to be opened.

Another objective of the present invention is to construct a lock pick that is capable of picking a previously "unpickable" lock.

Another objective of the present invention is to construct a lock pick to be utilized by individuals of limited education and experience to pick locks.

Another objective of the present invention is to construct a lock pick that can utilize a rigid saw type of blade that moves horizontally, in and out of the keyway of a lock and is intended to destroy the lock pins of a lock in order to obtain quick opening in an emergency or life threatening situation.

Another objective of the present invention is to construct a lock pick which uses a plurality of deflectable members as the device which contacts the lock pins for affecting the movement of the lock pins with these deflectable members comprising one or more single type members, loops, or bristles of a brush.

Another objective of the present invention is to construct a lock pick which is constructed in the form and in the shape of a key which utilizes a plurality of tufts of flexible bristles as a structure to affect the movement of the lock pins.

DETAILED DESCRIPTION OF THE PREFERRED EMBODIMENT

Figure 1:
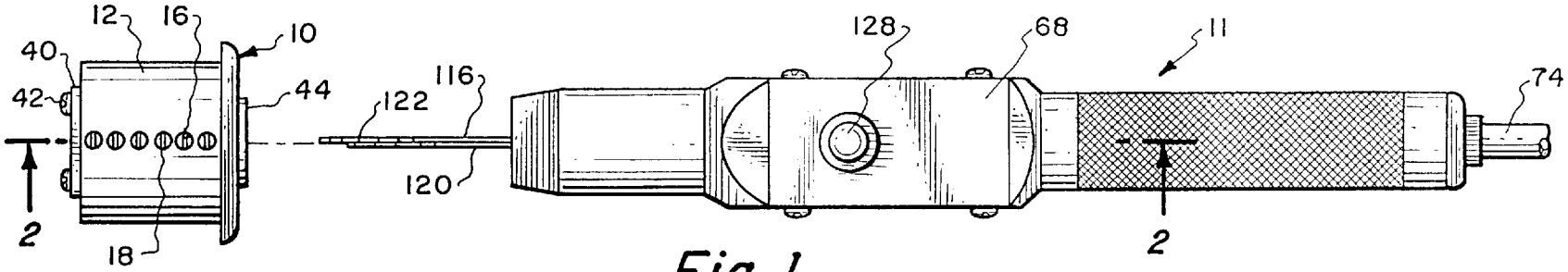
FIG. 1 a top plan view of the motorized version of lock pick of the present invention depicting the interconnection with a lock that is to be picked showing double blades with the alternative use of a single blade not being shown.

Referring particularly to the drawings, there is shown a cylindrical lock 10 which has a cylindrical housing 12. The housing 12 includes a through opening 14. Connecting with the through opening 14 are six in number of cross openings 16. The cross openings 16 are located in an in-line relationship and connect between the exterior sidewall of the cylindrical housing 12 and the through opening 14. The cross openings 16 are radially disposed relative to the longitudinal center axis of the cylindrical housing 12. The cross openings 16 are all of the same size and are also of the same length.

Mounted within each cross opening 16 is a set screw or plug 18. Interiorly of each plug 18 there is mounted a coil spring 20. Each coil spring 20 is to exert a continuous bias against a lock pin 22. Lock pin 22 is in line with top pin 25 and coil spring 20. It is to be understood that there are six in number of the lock pins 22 with there being an individual lock pin 22 for each coil spring 20. Lock pins 22 are basically identical with the exception that such may, in all probability, vary in length.

Each lock pin 22 has a flat upper end 24. The upper end 24 of each lock pin 22 is to be in contact with a top pin 25. The abutting surfaces of top pin 25 in conjunction with its respective lock pin 22 establishes a shear line which must be aligned with the interior surface of housing 12 and the exterior surface of plug 30 to permit the lock to open. A coil spring 20 connects with each top pin 25. Formed within the sidewall of each lock pin 22 is a longitudinal groove 26. Each lock pin 22 is to rest within a hole 28 formed within the plug 30. The chambers 28 are located in an in-line arrangement within the plug 30. The chambers 28 are of the same cross sectional size as the cross openings 16. Also, the spacing between the chambers 28 is the same as the spacing between the cross openings 16. Each hole 28 connects with a keyway 32 formed within the plug 30. The bottom end of each lock pin 22 may include beveled surfaces which may form into a chisel tip 34. Each groove 26 is oriented in a specific manner relative to its respective chisel tip 34.

The plug 30 is to be inserted within the through opening 14 with protrusion 36, which is formed on the rear surface of the plug 30, matingly located within a hole 38 formed within mounting plate 40. Mounting plate 40 is fixedly mounted onto the rear surface of the cylindrical housing 12 by means of conventional fasteners 42. It is the function of the mounting plate 40 to mount the plug 30 in its correct position within the cylindrical housing 12 and prevent the plug 30 from being removed from the housing 12. The front end of the plug 30 is formed into an enlarged disc 44 which is matingly located within annular groove 46 formed within the front end of the cylindrical housing 12.

Typical operation of the cylindrical lock 10 would be as follows: A key 48 is utilized which has an elongated blade 50. Formed within the upper edge of the blade 50 are a plurality of serrations 52. These serrations 52 are cut into the blade at various angular and longitudinal positions at various depths. When the blade 50 is fully inserted within the keyway 32 along the longitudinal center axis of the cylindrical housing 12, the sharpened line 34 of each lock pin 22 comes into contact with a particular serration 52. If the key 48 is the correct key for the cylindrical lock 10, the depth of the serrations 52 will be correct for each lock pin 22 so that the upper end 24 of the lock pins 22 will all be aligned with the shear line. In a conventional type lock that would normally be sufficient to permit the plug 30 to be pivoted relative to cylindrical housing 12 and affect opening of the lock 10. However, in the particular lock shown in this invention, that is not sufficient as the lock pins 22 must also be pivoted according to the angular arrangement of each serration 52 on the blade 50. This angular displacing of the lock pins 22 is so that each of the slots 26 will line up directly facing a locking bar 54. The inner surface of the locking bar 54 is formed into six in number of spaced-apart tabs 56. A tab 56 is to be locatable within a groove 26 with there being a separate tab 56 for each longitudinal groove 26. The locking bar 54 is movably mounted in the cylindrical housing within side slot 58 which is formed within the plug 30. The locking bar 54 includes an elongated protrusion 60 which is to be connectable with an elongated slot 62 formed within the sidewall of the through opening 14 of housing 10. Within the side slot 58 and located between the plug 30 and the locking bar 54 are a pair of coil springs 64. It is the function of the coil springs 64 to exert a continuous bias on the locking bar 54 tending to locate elongated protrusion 60 in connection with the elongated slot 62. The upper surface of elongated protrusion 60 is beveled as is also one side of the elongated slot 62. A camming action occurs when tabs 56 are engaged with slots 26 during pivoting of plug 30. This camming action causes locking bar 54 to move inwardly disengaging elongated protrusion 60 from elongated slot 62. When each of the locking pins 22 are pivoted to the correct position, the connection of the tabs 56 with the slots 26 will occur and with the upper surface 24 of pins 22 aligned at the shear line, then rotation of the plug 30 will occur relative to the cylindrical housing 12.

Figure 2:
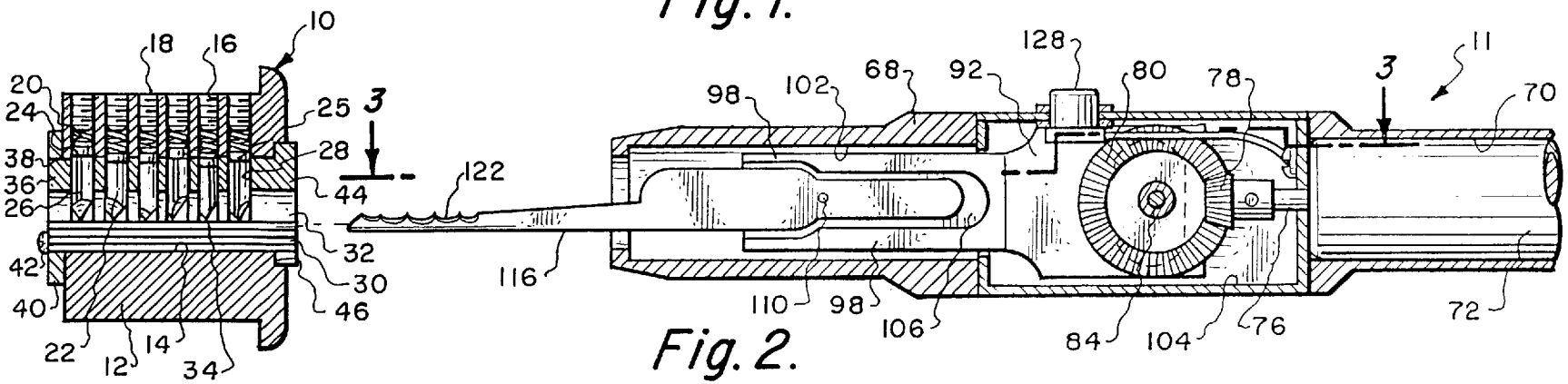
FIG. 2 is a cross-sectional view through both the lock pick and the lock taken along line 2—2 of FIG. 1.
Figure 3:
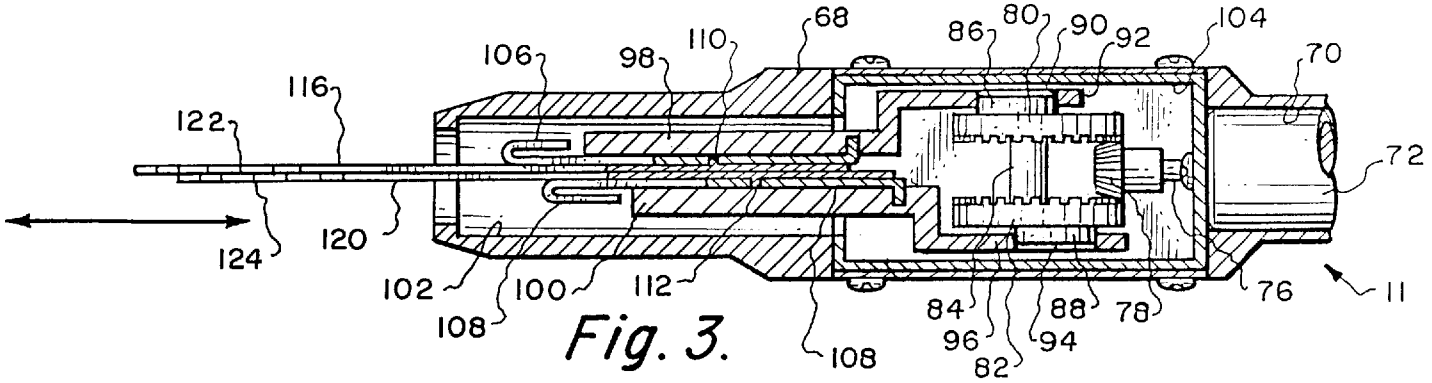
FIG. 3 is a cross-sectional view through the lock of the present invention taken along line 3—3 of FIG. 2.
Figure 4:
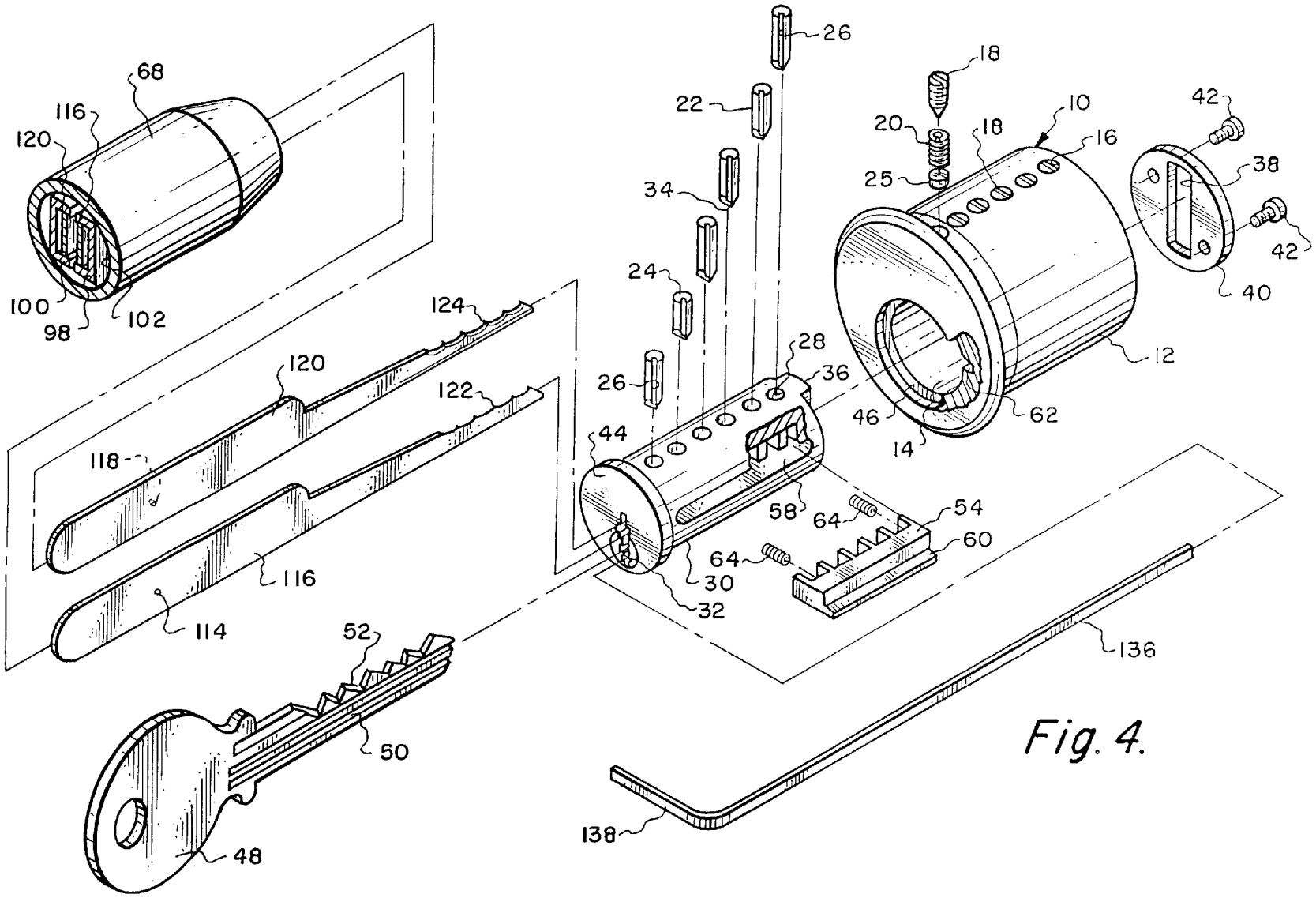
FIG. 4 is an exploded isometric view of the blades incorporated within the lock pin apparatus of the present invention shown in conjunction with the lock to be picked.

Let it now be assumed that there is not a key 48 available. The one who has possession of the lock 10 desires to have the lock 10 be opened. In order to achieve that opening, it would be necessary to utilize the lock picking apparatus 11 of this invention. Referring particularly to FIGS. 1 to 3 of the drawings, the lock picking apparatus 11 includes a housing 68. Located within the housing 68 is a motor chamber 70 and mounted within that motor chamber 70 is a small electric motor 72. This electric motor 72 is to be driven by a source of electrical energy to which wire 74 connects. The motor 72 has an output shaft 76 to which is mounted a bevel gear 78. The bevel gear 78 is engaged with a pair of ring gears 80 and 82, which are also bevel gears, which are mounted in a spaced apart relationship. Both ring gears 80 and 82 are pivotably mounted on a pivot pin 84. Mounted off-center on the ring gear 80 is a hub 86. A similar hub 88 is off center mounted on the ring gear 82. The hub 86 rides within a hole 90 formed within an arm 92. In a similar manner, the hub 88 rides within a hole 94 formed within an arm 96.

The arms 92 and 96 are basically identical except they are mirror images of each other. The arms 92 and 96 respectively include outer sections 98 and 100 which are located in juxtaposition within the confines of blade chamber 102. Bevel gear 78 and the ring gears 80 and 82 are located within gear chamber 104. It is to be understood that the chamber 102 connects with the chamber 104. Mounted on the inside surface of the outer section 98 is a blade mount member 106. A similar blade mount member 108 is mounted on the inside surface of the outer section 100. Blade mount members 106 and 108 function to exert a bias toward each other. Blade mount member 106 includes a small hole which is to connect with protrusion 110. In a similar manner, the blade mount member 108 includes a small hole which is to connect with protrusion 112. Protrusion 110 is integral with the body of a blade 116. Protrusion 112 is integral with the body of a blade 120. The bias of the blade mount members 106 and 108 is to tend to keep the blades 116 and 120 in abutting contact with each other. The blade 116 includes a hiatused upper surface 122 with blade 120 having a similar hiatused upper surface 124. It is to be understood that there will probably be utilized as many as a hundred different shapes of hiatused surfaces 122 and 124. The hiatused surfaces 122 and 124 could constitute no more than a slight arcuate shape or could comprise a saw blade. It is to be understood that the blades 116 and 120 are to be movable from their respective blade mounting members 106 and 108 with different blades to then be connectable with blade mounting members 106 and 108.

When a user presses button 128, the motor 72 rotates the ring gears 80 and 82. As the hubs 86 and 88 move within their respective holes 90 and 94, members comprising the outer sections 98 and 100 are driven in a reciprocal manner relative to the housing 68. With the outer sections 98 and 100 being driven reciprocally, so also are the blades 116 and 120. It is to be noted that when blade 116 is moved in an outward direction, blade 120 is being moved in an inward direction and vice versa.

Figure 5:
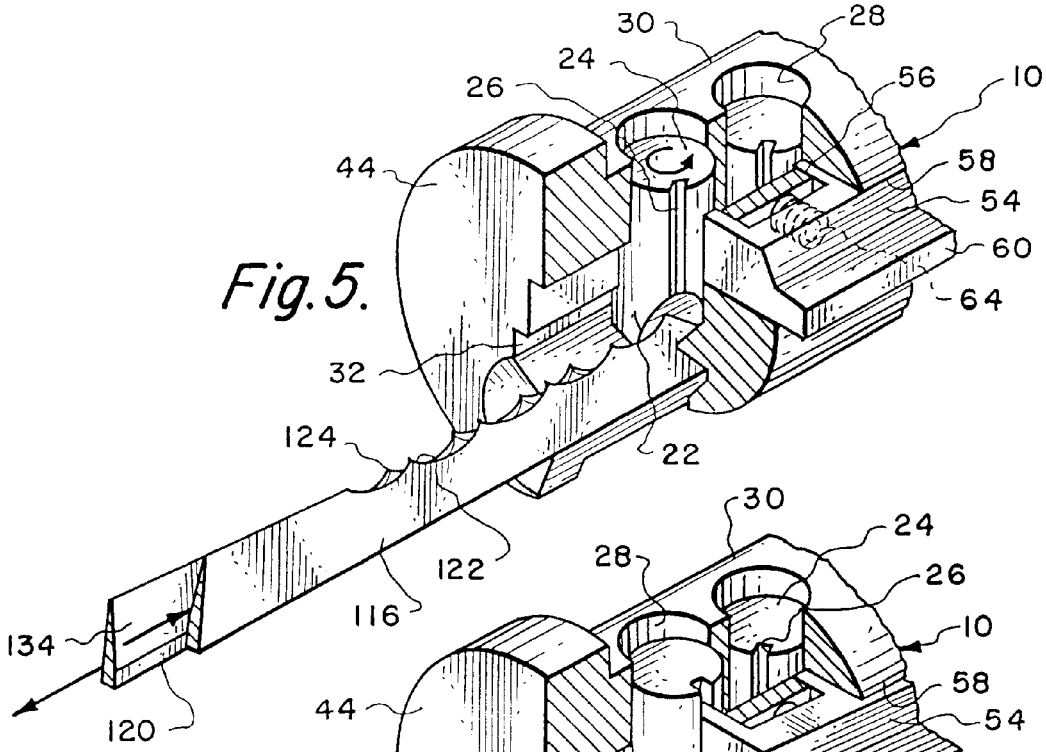
FIG. 5 is a cut-away isometric view depicting movement of the blades within the lock in order to achieve the picking of the lock.
Figure 6:
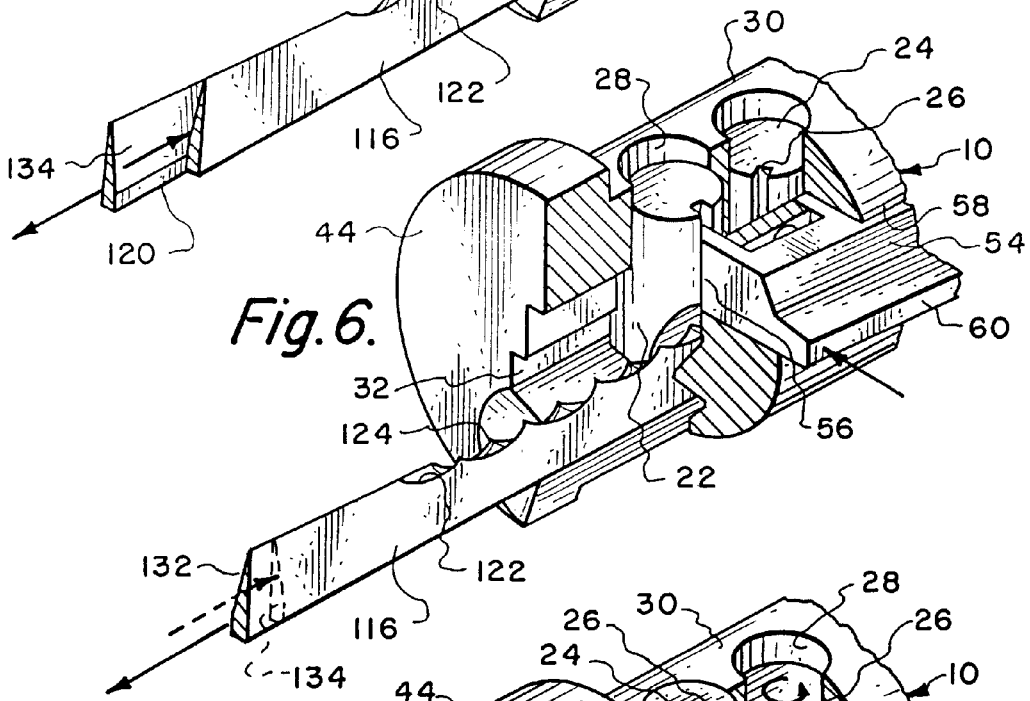
FIG. 6 is a view similar to FIG. 5 but showing one of the lock pins within the lock being oriented in the "picked" position.
Figure 7:
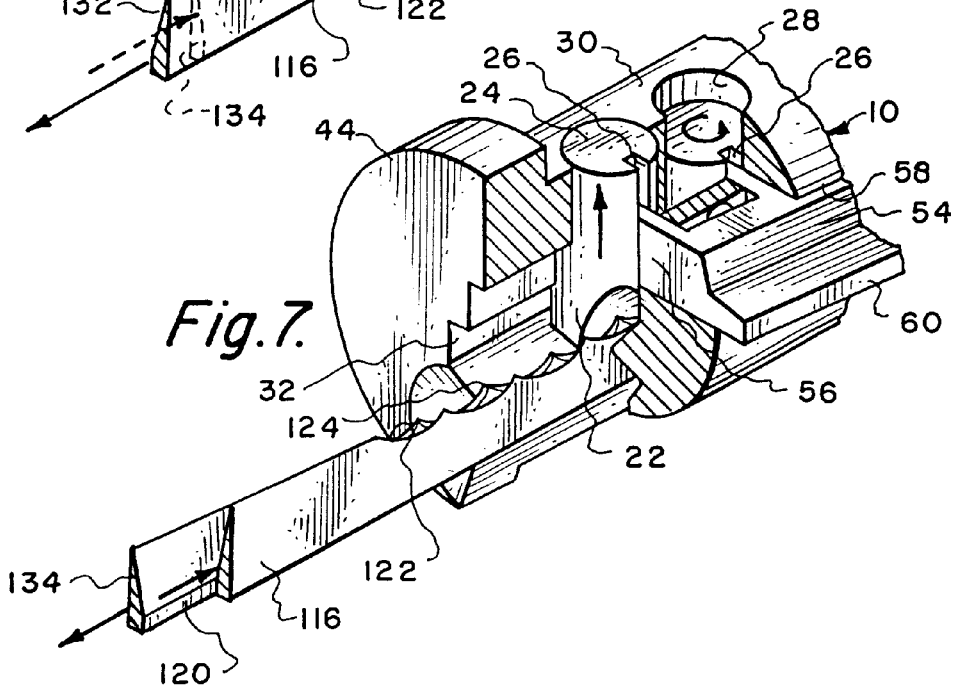
FIG. 7 is a view similar to FIG. 6 but showing a second lock pin within the lock also being located in the "picked" position.

It is to be noted that the hiatused upper surface 122 is beveled producing a sharp surface on the surface 122 which is in alignment with the side surface of the blade 116 that is located directly against the blade mounting member 106. The same is true for the blade 120, with its sharpened edge being in alignment with the side surface of the blade 120 that is located directly against the blade mounting member 108. This in essence produces a v-shaped elongated slot, which could be called a cutout, between the blades 116 and 120. The beveling is shown as surface 132 on blade 116 in FIG. 6 and as surface 134 of blade 120 in FIGS. 5 and 7 of the drawings.

As the blades 116 and 120 are moved inward and outward within the keyway 32, the lock picking surfaces produced by the interacting hiatused surfaces 122 and 124 are constantly changing. In essence, a vast number (infinite) of different lock picking surfaces are produced as the blades 116 and 120 move inward and outward. This constantly changing "code" facilitates the lock picking procedure.

The operation of the motorized version of lock pick apparatus shown in FIGS. 1 to 4 of the drawings is as follows: Let it be assumed that the key 48 is, for whatever reason, not available. The user inserts torque tool 136 into keyway 32 and pushes on L-shaped end 138 which will exert a small force trying to pivot plug 30 relative to the housing 12. However, this pivoting is prevented because the top of bottom lock pins 22 are not located at the shear line and the tabs 56 of the locking bar 54 are not each located within a longitudinal groove 26. The blades 116 and 120 are then inserted within keyway 32. The button 128 is pressed and the motor rotates the ring gears 80 and 82 which results in the blades 116 and 120 to move back and forth within the keyway 32. The hiatused upper surfaces 122 and 124 displace the lock pins in an upward direction within their chambers 28. These lock pins 22 are free to move up and down with the downward pressure being caused by the biasing of the coil springs 20. Upon a lock pin 22 reaching the shear line, there will be a tendency for the lock pin 22 to be held in that position due to the action of the force that is applied by the torque tool 136 to the plug 30. When upper surface 24 of each of the lock pins 22 has been located at the shear line, the plug 30 could normally be pivoted relative to the housing 12. However, this is prevented because the tabs 56 are not located within the slots 26 of the lock pins 22. However, simultaneously with the in and out movement of the blades 116 and 120, each sharp pointed line 34 of the chisel tipped lock pins 22 is physically and continually contacted by the upper surfaces 122 and 124 in an off-center manner. This tends to cause the lock pins 22 to pivot within their chambers 28. Upon groove 26 of pin 22 aligning with its respective tab 56, the tab will then partially enter the groove 26 and further pivoting movement of that lock pin 22 is then prevented. When all of the tabs 56 are located within their respective slots 26, the lock bar 54 will slip out of the slot 62, again caused by the application of the torque by torque tool 136 to the plug 30. At this time, plug 30 should now pivot relative to the housing 12 and the lock 10 is opened.

Although the structure of the present invention has been described in conjunction with using two blades 116 and 120, it is considered to be within the scope of this invention that the lock picking apparatus 11 of this invention could use just one blade instead of two blades. The one blade could be constructed similar to blade 116 or could be similar to blade 120. Also it is considered to be within the scope of this invention that the one blade could not have a beveled upper edge and be basically constructed which is similar to prior art blades. Also it is considered to be within the scope of this invention that when using two blades, one blade could be a conventional prior art blade and the other blade could be a beveled blade.

Figures 8, 9:
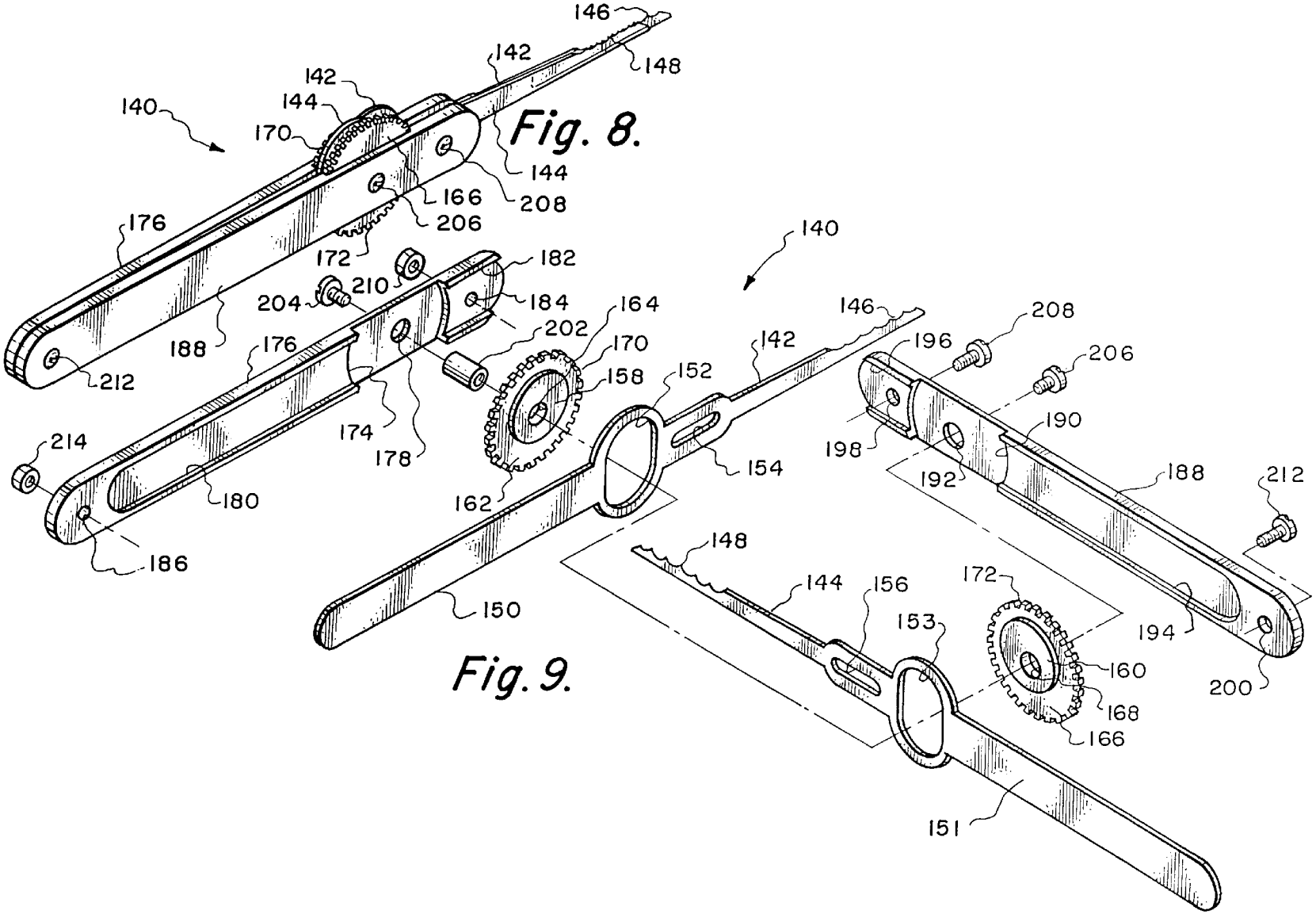
FIG. 8 is an isometric view of a manually operated version of the lock picking apparatus of the present invention.
FIG. 9 is an exploded isometric view of the manually operated version of the lock picking apparatus of the present invention using two blades in parallel but acknowledging that this version could be used with only one blade.

Referring particularly to FIGS. 8 and 9 of the drawings, there is shown a manual version 140 of the lock picking apparatus of this invention. This manual version 140 utilizes blades 142 and 144 each of which has respectively hiatused upper surfaces 146 and 148. These hiatused upper surfaces are basically similar in construction to the previously described upper surfaces 122 and 124. The blades 142 and 144 are constructed to be essentially identical with blade 142 having a member defined as an elongated body 150 and blade 144 having a member defined as an elongated body 151. Formed within the body 150 is an enlarged opening 152 with a similar enlarged opening 153 being formed within the body 151. Also formed within the body 150 is a slot opening 154 with a similar slot opening 156 being formed within the body 151. The openings 152 and 153 are the same size as well as the slot openings 154 and 156.

Offset hub 158 is to be located within the enlarged opening 152. A similar offset hub 160 is to be located within the enlarged opening 153. Offset hub 158 is formed integral with wheel 162. In a similar manner, the offset hub 160 is formed integral to a wheel 166. Wheel 162 includes an opening 164. Wheel 166 includes an opening 168. The opening 164 is centrally located relative to the wheel 162. The opening 168 is also centrally located relative to wheel 166. However, the opening 164 which also extends through the offset hub 158 is not centrally located relative to the offset hub 158. In a similar manner, the opening 168 which passes through the offset hub 160 is not centrally disposed relative to the offset hub 160. This means that the discs 158 and 160 are off-center relative to the pivot axis established by the openings 164 and 168.

The wheel 162 includes a serrated peripheral edge 170. The wheel 166 includes a similar serrated peripheral edge 172. The wheel 162 is to be mounted within cutout section 174 of a handle member 176. Centrally formed within the cutout section 174 is a hole 178. The inside surface of the handle member 176 includes an elongated recess 180. The elongated body 150 is to rest within the elongated recess 180 with the wheel 162 resting within the cutout section 174. The inside surface of the handle member 176 includes a forward cutout area 182. Formed within this area 182 is a hole 184. Formed within the rear portion of the handle member 176 is a hole 186.

There is also utilized another handle member 188 which is to be mounted in a facing relationship with the handle member 176. This handle member 188 includes a cutout section 190 within which is to be located the wheel 166. The cutout section 190 also includes a centrally located hole 192. The inside surface of the handle member 188 includes an elongated recess 194 and a forward cutout area 196. Located within the forward cutout area 196 is a hole 198 as well as there being a hole 200 formed within the rear portion of the handle member 188.

The wheel 166 is to be located within the cutout area 190 with hole 168 aligning with hole 192. The body 151 is mounted within the elongated recess 194 with the forward section of the blade 144 connecting with the forward cutout area 196. The hole 198 aligns with slot 156.

In a similar manner, the wheel 162 is to be located within a cutout area 174 with hole 164 aligning with hole 178. The body 150 is located within an elongated recess 180 with the forward area of the blade 142 extending through forward cutout area 182 with slot 154 aligning with hole 184. Blades 142 and 144 are then located in juxtaposition and abutting each other. A sleeve 202 extends between holes 164 and 168. A screw fastener 204 extends through hole 178 and is tightly secured to the sleeve 202. Similarly, a screw fastener 206 extends through the hole 192 and is also tightly secured to the sleeve 202. Screw fastener 208 extends through aligned holes 198 and 184 with fastener 208 being tightly secured to a knob 210. Screw fastener 212 extends through holes 200 and 186 and is tightly secured to a knob 214.

It is to be noted that the offset hub 160 is positioned about one hundred and eighty degrees from the position of the offset hub 158, but each blade is independently operated from the other and can take on any sequence of in and out movement. When a human manually turns the wheels 166 and 162 simultaneously by the application of a thumb, offset hub 158 will be rotated within the enlarged opening 152. In a similar manner the offset hub 160 will be rotated within the enlarged opening 153. Because discs 158 and 160 are displaced from one another about one hundred and eighty degrees, blade 142 will be driven in an outward direction while blade 144 will be driven in an inward direction. This lineal driving force of the blades 142 and 144 is caused by the offset hub 158 moving against the sidewalls of the enlarged opening 152 as it is rotated. The same is true for the offset hub 160 relative to the walls of the enlarged opening 153. The body 150 lineally moves within the elongated recess 180 with the body 151 lineally moving within the elongated recess 194.

It is to be understood that the blades 142 and 144 are to be inserted in conjunction with the keyway 32. The hiatused upper edges 146 and 148 are to be moved within the keyway 32 in the same manner as the hiatused upper surfaces 122 and 124 are moved. The movement of the blades 142 and 144 is accomplished by manually turning of the wheels 162 and 166. The serrated surfaces 170 and 172 are for the purpose of facilitating this manual turning when contacted by the thumb of the operator. It is to be understood that the manual version 140 is to achieve the same end result of picking of the lock 10.

Figures 10, 11, 12, 13, 14:
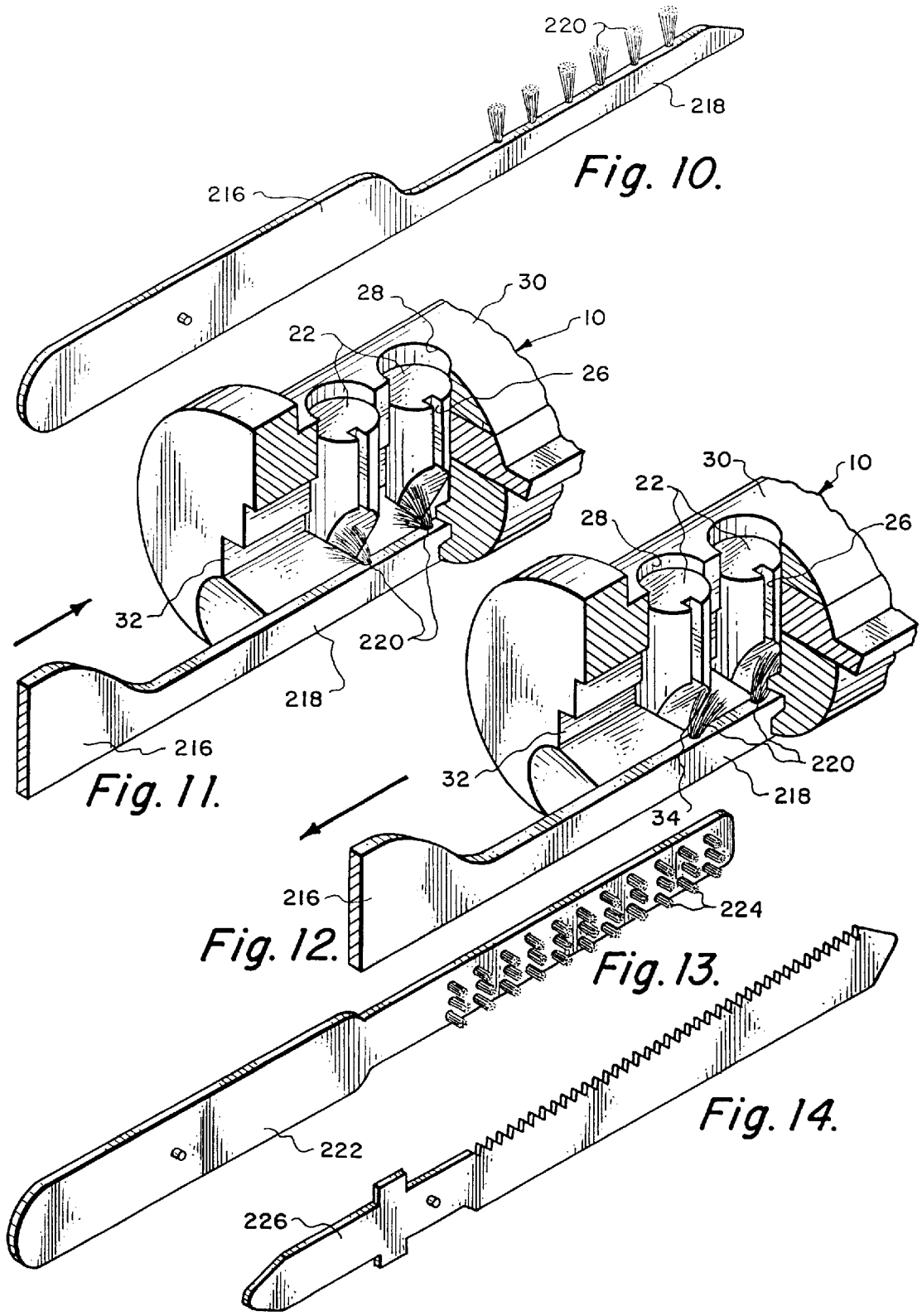
FIG. 10 is an isometric view depicting a blade to be used within the lock pick of the present invention where the blade utilizes a plurality of tufts of deflectable bristles with in essence the blade assuming the configuration of a brush.
FIG. 11 is an isometric view, partly in cross-section, depicting inward movement of the brush type blade of FIG. 10 within a keyway of a lock.
FIG. 12 is a view similar to FIG. 11 but showing the position of the tufts of deflectable bristles during outward movement of the blade of FIG. 10.
FIG. 13 shows a modified form of blade wherein the tufts of deflectable bristles composing the brush are mounted on the side of the blade rather than on an upper edge, permitting the blade of FIG. 13 be used with horizontally oriented pins, rather than vertical oriented pins, of the lock.
FIG. 14 depicts another version of tool to be used within the keyway of the lock where the tool is constructed to be a saw blade.

Referring particularly to FIGS. 10–12 of the drawings, there is shown a modified form of blade 216. The blade 216 has operating end 218 which is intended to be inserted within the keyway 32 of the plug 30 of the lock 10. Fixedly mounted within the operating end 218 are a plurality of tufts 220 of deflectable bristles. The tufts 220 are mounted in an in-line position on the operating end 218. The tufts 220, which may be identical, are located in a spaced-apart manner on the operating end 218. The tufts 220 can be constructed of flexible hair material or could possibly be constructed of a mass of fine metallic flexible wire material.

In and out movement of the operating end 218 within the keyway 32 will cause the tufts 220 to come into contact with the sharpened point 34 of the lock pins 22. The tufts 220, by brushing by of the lock pins 22, will cause the lock pins 22 to raise within their respective chambers 28. The in movement of the operating end 218 is depicted in FIG. 11 depicting how the tufts 220 are deflected when coming into contact with the lock pins 22 and the out movement of the operating end 218 is shown in FIG. 12, again showing the position of the tufts 220 being deflected when coming into contact with the lock pins 22. It is to be noted that the deflection of the tufts in FIG. 12 is in a forward direction with the deflection in FIG. 11 being in a rearward direction.

The advantage of using the brush type blade shown in FIGS. 10–12 is that once a lock pin 22 becomes located at the shear line, further movement of the blade does not dislodge that lock pin 22 from the shear line. Instead the tufts 220 will merely deflect when moving past the lock pin 22 that is located in the shear line and not dislodge it from the shear line position. One problem with using rigid blades having hiatused upper surfaces 122 and 124 is that protrusions on these surfaces 122 and 124 can actually dislodge the lock pin 22 from the shear line position once it has already been established. Utilizing the brush type of tool of FIGS. 10–12 eliminates this problem.

Also, some locks locate the lock pins 22 from the generally vertically oriented position depicted in the drawings to a horizontal orientation. In that particular position the lock pin 22 would enter the keyway 32 from the side. In such a situation, the tool 222 shown in FIG. 13 is used which has a plurality of tufts 224 of flexible bristles. The tufts 224 are located on the side of the tool 222 as the tool 222 is moved reciprocally within the keyway 32. The tufts 224 brush against the lock pins (not shown) that are mounted in a horizontal position within the plug 30.

In some instances the lock may simply not be pickable. In such an instance, the only way to break into the lock would be to destroy the lock. Destruction of the lock usually occurs by filing down the lock pins 22 which causes the top pins 25 to become spaced from the shear line which would then permit the lock to be opened. The top pins 25 move into the space previously occupied by the lock pins 22 (which are now destroyed) away from the shear line. In order to complete the destruction of the lock pins 22, a saw blade type of tool 226 is to be inserted within the keyway 32. Repeated in and out movements of the saw blade tool 226 will result in the destruction of the lock pins 22.

Figure 15:
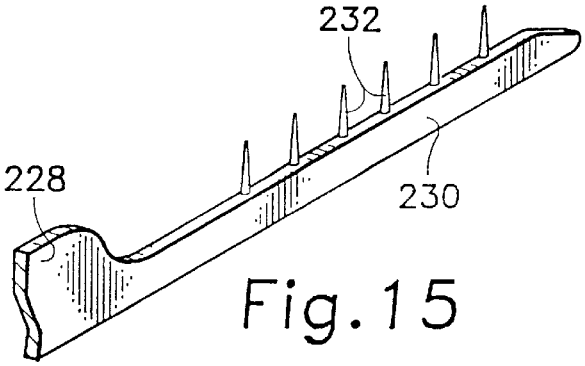
FIG. 15 depicts yet another version of the tool of the present invention to be used within the keyway of the lock where the blade of the tool includes a plurality of deflectable members which are designed to come into contact with the lock pins and affect movement of the lock pins.

Referring particularly to FIG. 15 of the drawings, there is shown a blade 228 which is basically similar to blade 216. Integrally connected to the blade 228 is an operating end 230. The operating end 230 is basically similar to operating end 218. However, instead of tufts 220 that are mounted on the operating end 230, there are a plurality of evenly spaced-apart, pointed members 232. Each of the members 232 are deflectable, and when passing under a lock pin the members 232 are sufficiently rigid to overcome the biasing force of the lock pin and raise the lock pin 22 sufficiently enough to not block the shear line of the lock. However, the members 232 will also deflect to permit the passage past a lock pin 22 that is located at a non-blocking shear line position. Typical material for the flexible members 232 would be a plastic type of material. It is considered to be within the scope of this invention that any number of the members 232 could be utilized from one to ten or more in conjunction with an operating end 230. The length and diameter of each of the flexible members 232 will vary according to each requirement and application.

The members 232, in essence, function in the same manner as the tufts 220. When a lock pin 22 of the lock reaches a shear line, as previously mentioned, that lock pin 22 becomes slightly locked in position. The locked in position lock pin 22 will tend to remain in that position and not be dislodged therefrom when using of the blade 228 since the deflectable members 232 will merely deflect and pass by that lock pin 22 and will still function against other lock pins to move the lock pins toward the shear line.

Figure 16:
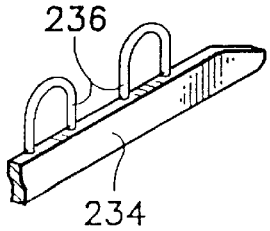
FIG. 16 is a modified form of the lock picking blade shown in FIG. 15 where directly adjacent deflectable members are connected together to form a loop.

Referring particularly to FIG. 16 of the drawings, there is a modified form of blade 228 which has an operating end 234. Mounted on the operating end 234 are a pair of loops 236. The loops 236 are, in essence, no more than a joined pair of directly adjacent members 232. The loops 236 will also deflect as previously discussed in relation to the members 232.

Figure 17:
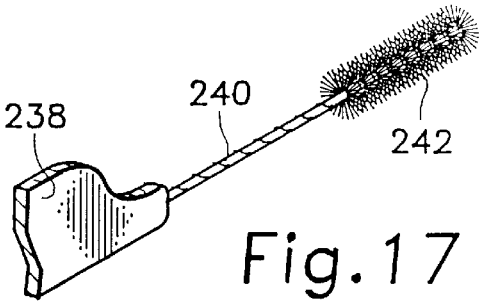
FIG. 17 is an isometric view depicting a circular type brush of deflectable members to be used as the device to affect movement of the lock pins within the keyway.

Referring particularly to FIG. 17 of the drawings, there is shown a blade 238 which has a wire member 240 extending therefrom. Centrally mounted on the outer end of the wire end 240 is a cylindrical shaped brush 242. The cylindrical shaped brush 242 functions in the same manner as the tufts 220 which have been previously discussed. The bristles of the brush 242 will deflect when passing by the lock pins 22 but yet function to physically move the lock pins 22 when they are not located at the shear line.

Figure 18:
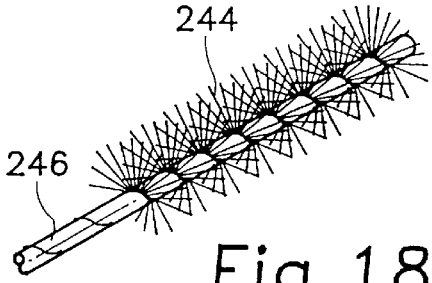
FIG. 18 is an isometric view of the brush similar to what is shown in FIG. 17 but where the deflectable bristles of the brush are mounted in a spiral pattern on the central supporting rod of the brush.

Referring particularly to FIG. 18 of the drawings, there is shown a modified form of brush wherein bristles 244 of the brush are mounted on the central wire member 246 in a spiral pattern. The spiral arrangement of the bristles 244 functions to apply an uneven pressure laterally across the surface of each of the lock pins with this uneven pressure tending to lift and simultaneously pivot the lock pins 22. This type of pivoting of the lock pins 22 is desirable because, as previously discussed, some locks require the lock pins 22 to be pivoted to a certain position in order to permit opening of the lock. The fact that the bristles of the brush 244 are not mounted in a straight, perpendicular pattern across the rod 246 produces a pivoting of the chisel tipped lock pins 22 when the brush 246 moves lineally in and out of the lock because of being offset from center line contact with chisel tipped lock pins 22.

Figure 19:
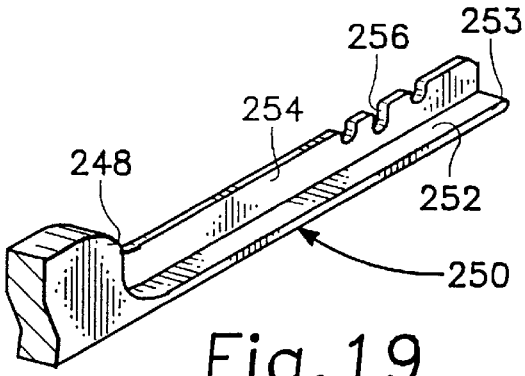
FIG. 19 is an isometric view of a portion of the blade included within the lock picking apparatus of the present invention which shows a different version of an offset type of blade in order to achieve pivoting of the chisel tipped lock pins as the blade is moved in and out.

Referring particularly to FIG. 19 of the drawings, there is shown another way that the lock pins 22 could be pivoted by means of a blade 248 which is similar to blades 116 and 120 and has an operating end 250. The operating end 250 has a horizontal shelf 252. One side edge of the horizontal shelf 252, which in the case of FIG. 19 is the left edge of the horizontal shelf 252, is cutout which forms a greater height wall 254 relative to height of the opposite side wall 253 forming an L-shape. The wall 254 is hiatused at its upper edge forming a series of recesses 256. The recesses 256 are to contact the left edge of surface 34 of chisel tipped lock pins 22 as the operating end 250 moves in and out of the lock. This will result in pivoting action of the chisel tipped lock pins 22. It is to be understood that a blade could be constructed which is basically similar to that shown in FIG. 19, except that the vertical wall 254 is located on the right side of the horizontal shelf 252 and if used with the blade that has a vertical wall 254 on the left side of the horizontal shelf 252 will result in a rectangular shaped cutout.

Figure 20:
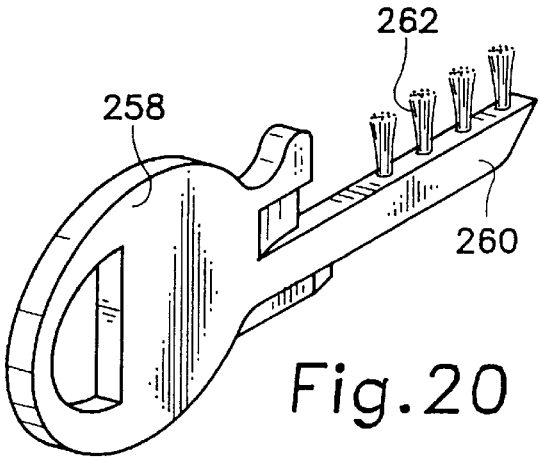
FIG. 20 is an isometric view of a key which is constructed to include tufts of deflectable bristles where the key can be used as a lock/picking device.

Referring particularly to FIG. 20 of the drawings, there is shown a lock picking apparatus which is formed in the shape of a key 258. The key 258 includes an operating end 260 on which are mounted a plurality of tufts 262 of flexible bristles. When the operating end 260 is inserted within the keyway of the lock, the entire operating end 260 will function as a tension wrench for the plug 30. In other words, a slight torque is to be applied to the key 258, and then the key 258 is moved reciprocally within the keyway. While the key 258 is being moved reciprocally, the operating end 260 applies a continuous tension force against the plug 30. As the operating end 260 is moved reciprocally within the keyway, the tufts 262 of deflectable bristles function to exert force against the lock pins 22 attempting to have the lock pins 22 come to rest at the shear line. Once all the lock pins 22 are at the shear line, the tension force that is caused by the operating end 260 causes the plug 30 to pivot and the lock is opened.

Figure 21:
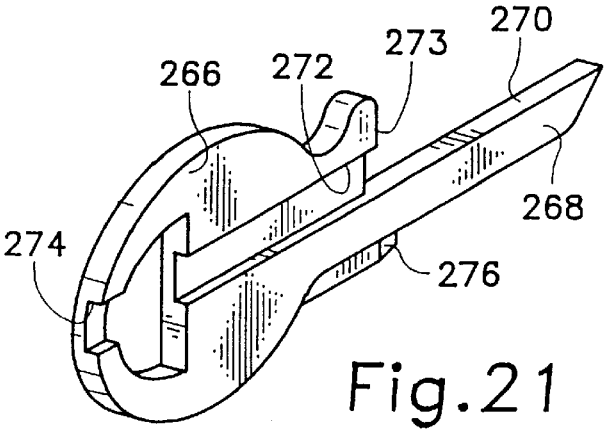
FIG. 21 is an isometric view of a blank form of key which is used as a tension wrench and includes grooves to permit the connection of a blade such as is shown in FIGS. 15, 16, 17, 18 and 19 to be used in order to pick the lock.

Referring particularly to FIG. 21 of the drawings, there is shown a modified form of key 266 which has an operating end 268 which includes a horizontal shelf 270. Included within the body of the key 266 is an inner groove 272 and an outer groove 274. The stop 273 of key 268 is modified to allow tab 276 to enter the keyway 32 of plug 30. A blade, such as a blade 228 shown in FIG. 15, is to be connected within the grooves 272 and 274 and then with the key 266 inserted within the keyway 32 and a torque applied thereto, a tension force, greater than what would normally be generated by just the operating end 268, will be produced by the tab 276 against the plug of the lock. The reciprocating of the blade 228 relative to the key 266 will result in vertical movement of the lock pins to the shear position and opening of the lock. It is also to be understood that blades 116, 120, 234, 238, 246, 248 and all other standard type blades on the market can be used in conjunction with key 266.

What is claimed is:

1. A lock picking apparatus for a lock which has a lock housing within which are mounted a plurality of separate lock pins engaging with a keyway, said keyway having a longitudinal axis, said lock pins being capable of movement transversely relative to said longitudinal axis, said lock picking apparatus comprising:

a pick housing;

a first elongated blade mounted on said pick housing, said first elongated blade having an upper edge which has a first hiatused surface which protrudes from said housing, said first elongated blade to be reciprocatingly moved within said keyway along said longitudinal axis with said first hiatused surface to directly contact said lock pins for the purpose of moving said lock pins to a shear line which will permit opening of said lock;

a first member mounted within said pick housing, said first elongated blade being mounted within said pick housing, said first member being connected to driving means, said driving means being rotatable, rotation of said driving means causes reciprocating movement of said first member resulting in repeated inward and outward movement of said first elongated blade within said keyway; and said driving means includes an electric motor.

2. The lock picking apparatus as defined in claim 1 wherein:

said first hiatused surface comprising a saw blade.

3. The lock picking apparatus as defined in claim 1 wherein:

there being a second elongated blade mounted in juxtaposition with said first elongated blade, said second elongated blade having an upper surface which has a second hiatused surface which protrudes from said housing, said second elongated blade to be reciprocatingly moved within said keyway along said longitudinal axis with said second hiatused surface to directly contact said lock pins for the purpose of moving said lock pins to a shear line which will permit opening of said lock, there being a second member mounted within said pick housing in juxtaposition with said first member, said electric motor being connected through a gearing arrangement with both said first member and said second member, said electric motor to also cause reciprocating movement of said second elongated blade.

4. The lock picking apparatus as defined in claim 3 wherein:

said first elongated blade abutting said second elongated blade.

5. The lock picking apparatus as defined in claim 3 wherein:

during inward movement of said first elongated blade said second elongated blade is being moved outward, during outward movement of said first elongated blade said second elongated blade is being moved inward, whereby a vast number of completely different lock picking surfaces are produced by the interacting movement of said first hiatused surface and said second hiatused surface with these lock picking surfaces being produced as said first elongated blade and said second elongated blade are moved.

6. The lock picking apparatus as defined in claim 3 wherein:

said gearing arrangement comprising a bevel gear which connects with two ring gears.

7. A lock picking apparatus for a lock which has a lock housing within which are mounted a plurality of separate lock pins engaging with a keyway, said keyway having a longitudinal axis, said lock pins being capable of movement transversely relative to said longitudinal axis, said lock picking apparatus comprising:

a pick housing;

a first elongated blade mounted on said pick housing, said first elongated blade having an upper edge which has a first hiatused surface which protrudes from said housing, said first elongated blade to be reciprocatingly moved within said keyway along said longitudinal axis with said first hiatused surface to directly contact said lock pins for the purpose of moving said lock pins to a shear line which will permit opening of said lock;

a first member mounted within said pick housing, said first elongated blade being mounted within said pick housing, said first member being connected to driving means, said driving means being rotatable, rotation of said driving means causes reciprocating movement of said first member resulting in repeated inward and outward movement of said first elongated blade within said keyway; and said first member having a first enlarged hole, a first offset hub mounted on said first elongated blade, said first offset hub to be located within said first enlarged hole with said first enlarged hole being substantially larger than said first offset hub, said first offset hub being non-centrally mounted on a first wheel, said first wheel protruding exteriorly of said pick housing and is manually rotatable which causes said first offset hub to rotate within said first enlarged hole which causes repeating lineal movement of said first elongated blade along said longitudinal axis of said keyway.

8. The lock picking apparatus as defined in claim 7 wherein:

there being a second elongated blade mounted in juxtaposition with said first elongated blade, there being a second member mounted within said pick housing in juxtaposition with said first member, said second member having a second enlarged hole, a second offset hub mounted on said second elongated blade, said second offset hub to be located within said second enlarged hole with said second enlarged hole being substantially larger than said second offset hub, said second offset hub being non-centrally mounted on a second wheel, said second wheel protruding exteriorly of said pick housing and is manually rotatable which causes said second offset hub to rotate within said second enlarged hole which produces repeating lineal movement of said second elongated blade along said longitudinal axis of said keyway.

9. The lock picking apparatus as defined in claim 8 wherein:

said second wheel being mounted in juxtaposition to said first wheel.

10. The lock picking apparatus as defined in claim 9 wherein:

during inward movement of said first elongated blade said second blade being moved outward, during outward movement of said first elongated blade said second elongated blade being moved inward.

11. The lock picking apparatus as defined in claim 10 wherein:

a V-shaped, elongated slot being formed between said first elongated blade and said second elongated blade.

* * * * *